United States Patent [19]

Murdock

[11] Patent Number: 5,044,021

[45] Date of Patent: Sep. 3, 1991

[54] CONTINUOUS SWIMMING APPARATUS

[75] Inventor: James Murdock, New York, N.Y.

[73] Assignee: Endless Pools, Inc., New York, N.Y.

[21] Appl. No.: 395,733

[22] Filed: Aug. 18, 1989

[51] Int. Cl.[5] ..... E04H 4/00

[52] U.S. Cl. ..... 4/488

[58] Field of Search ..... 4/488, 489, 491, 496

[56] References Cited

U.S. PATENT DOCUMENTS 722,232 3/1903 Hoeglauer ..... 4/488 X 1,731,554 10/1929 Wheeler ..... 4/496

FOREIGN PATENT DOCUMENTS 0218327 4/1987 European Pat. Off. ..... 4/488

2222594 11/1973 Fed. Rep. of Germany ..... 4/491

*Primary Examiner*—Charles E. Phillips

*Attorney, Agent, or Firm*—Louis M. Heidelberger; Robert C. Podwill

[57] ABSTRACT

A continuous swimming apparatus is provided which minimizes power requirements by providing higher water velocity through that portion of the swimming area in which the swimmer is located, and lower velocity in unused portions of the tank. This water velocity gradient is produced by an arrangement of turning vanes in the recirculation paths of the apparatus. The water velocity may be varied by adjusting hydraulic fluid flow to hydraulic motors which drive propellers for circulating the water through the apparatus.

15 Claims, 4 Drawing Sheets

CONTINUOUS SWIMMING APPARATUS

BACKGROUND OF THE INVENTION

1. Field of the Invention

The present invention relates to a continuous swimming apparatus wherein the swimmer remains stationary with respect to the apparatus while water in the tank circulates past the swimmer.

2. Description of the Related Art

Continuous swimming tanks are known generally. German Patent No. 2,222,594-Hoppe shows a continuous swimming tank. In the tank described therein, water circulates from the front of a swimming area past the swimmer to the rear of the swimming area where it is recalculated through a duct which runs beneath the floor of the swimming area. One set of turning vanes directs the water from the swimming area to the recirculation duct. The water passes over a propeller located in the duct and used for circulation. The second set of turning vanes directs the water from the recirculation duct back into the front of the swimming area.

The swimming area shown in the German '594 patent widens from the front of the tank to the rear of the tank. That is, the cross-sectional area of the swimming area increases from the front to the rear of the tank. This results in velocity variations over the length of the tank. The velocity of the flowing water is greater at the front of the swimming area than it is at the rear of the swimming area. Thus, a swimmer may choose where to swim, according to water velocity. The flow rate of water is constant anywhere in a given cross-section, perpendicular to the direction of water flow.

The problem with such a design is that it requires a large swimming area and thus a large swimming tank. Further, a large motor and great deal of power is required to circulate such a large volume of water.

U.S. Pat. No. 2,035,835—Raber shows a continuous swimming tank. In this reference, water is circulated either beneath the floor of the swimming area or around the sides of the swimming area. No turning vanes are used to direct the water. The problem with such a tank is that large amounts of turbulence are developed, and loss of water velocity results. Therefore, more power is needed to circulate the water, and swimming comfort is adversely affected by the turbulence.

SUMMARY OF THE INVENTION

The present invention avoids the power and size shortcomings of the aforementioned systems by providing a compact swimming apparatus. The apparatus consists essentially of a tank adapted to contain water and having a swimming area within the tank. Water flows through the swimming area from a water entrance end to a water exit end and returns to the water entrance end via a return path. Water circulation means is included in the return path for propelling the water through the return path and through the swimming area. A plurality of vanes is located in the return path to direct the water from the return path to the entrance end of the swimming area and from the exit end of the swimming area to the return path. The vanes help to minimize power losses by minimizing water turbulence. The vanes are spaced in such a way as to create a horizontal velocity gradient across the swimming area whereby water closer to the center of the swimming area has a higher velocity than water near the sides of the swimming area.

DESCRIPTION OF THE PREFERRED EMBODIMENT

Figure 1:
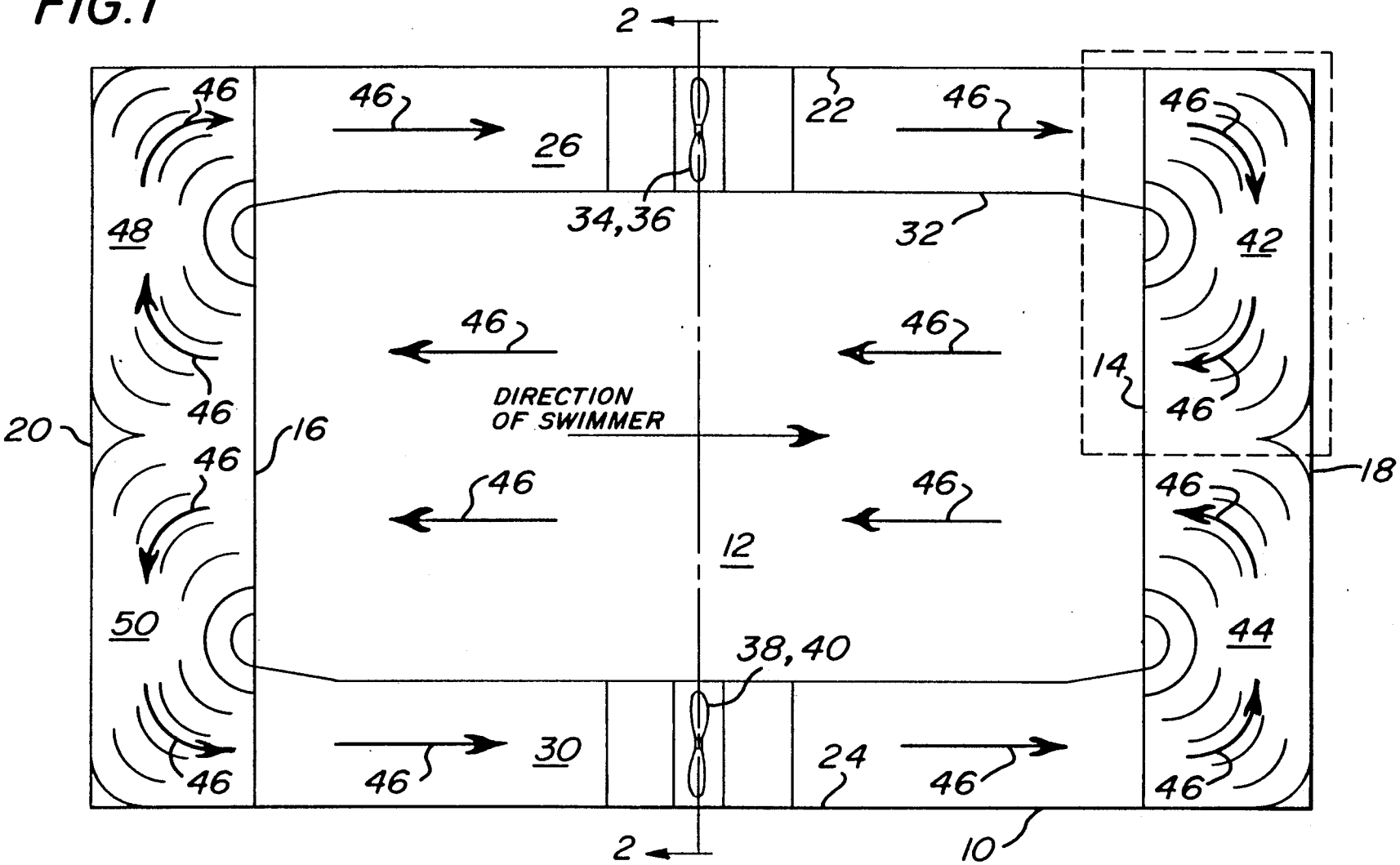
FIG. 1 is a plan view of the swimming tank of the present invention.
Figure 2:
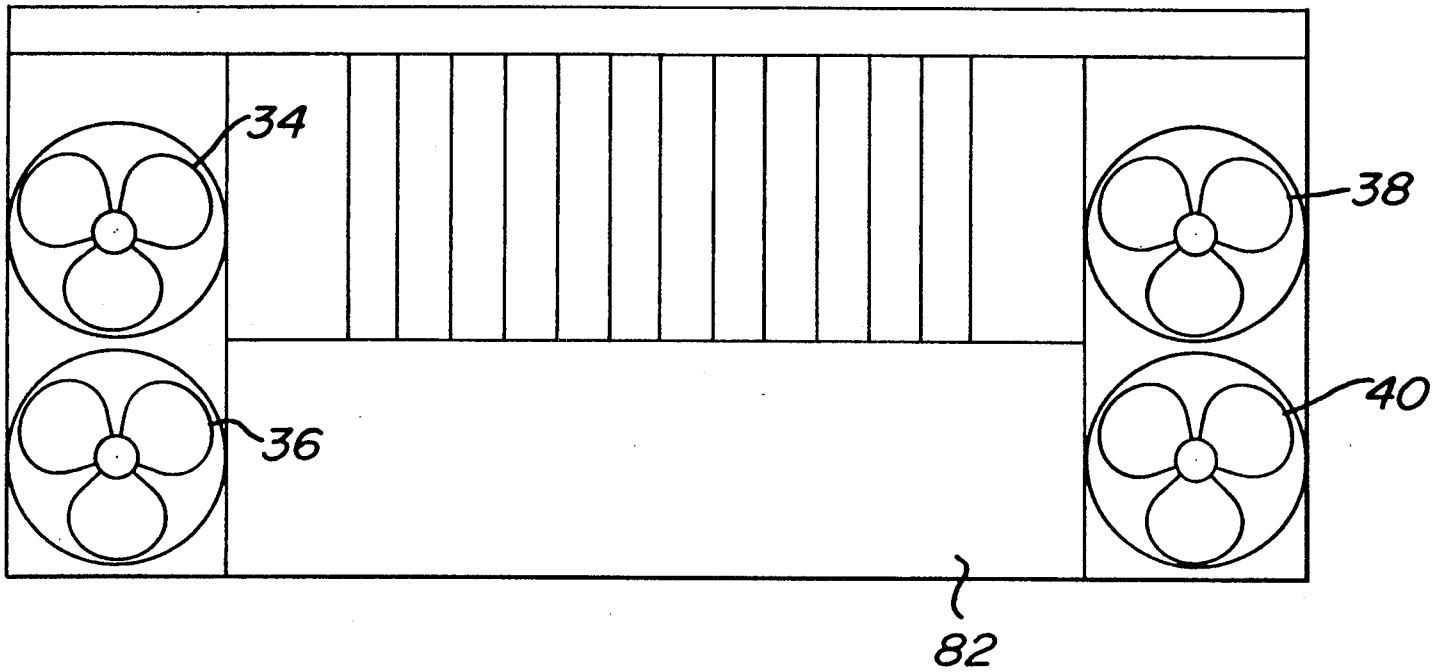
FIG. 2 is a cross-sectional view taken along line 2—2 of FIG. 1.

Referring to FIGS. 1 and 2, a swimming apparatus, constructed in accordance with the present invention, includes a tank 10 adapted to contain water and having a swimming area 12 through which water flows from a water entrance end 14 to a water exit end 16. Swimming area 12 is defined by right and left interior walls 28 and 32 respectively. For the preferred embodiment, tank 10 is rectangular and has front and rear endwalls 18 and 20 respectively and left and right sidewalls 22 and 24 respectively which are longer than the endwalls.

Tank 10 also has return means for directing water from water exit end 16 of swimming area 12 to water entrance end 14 of the swimming area. The return means include a first return path 26 extending between left interior wall 32 and left sidewall 22 from water entrance end 14 of swimming area 12 to water exit end 16 of the swimming area, and a second return path 30 extending between right interior wall 28 and a right sidewall 24 from the water entrance end of the swimming area to the water exit end of the swimming area.

Figure 4:
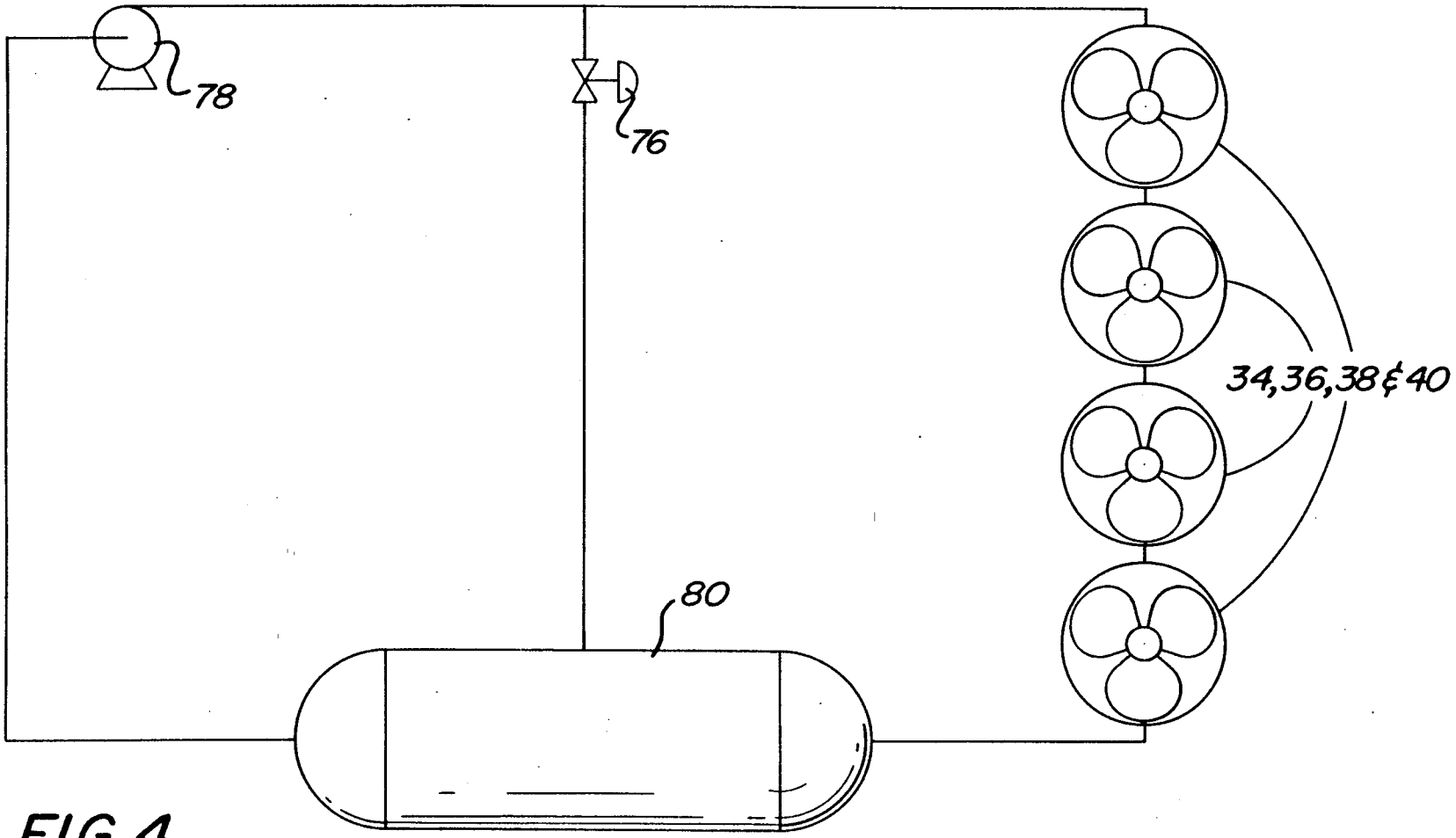
FIG. 4 is a schematic of the hydraulic system for use in the present invention.

A swimming apparatus, constructed in accordance with the present invention, also includes water circulation means for circulating water through the swimming area 12 from water entrance end 14 of the swimming area to water exit end 16 of the swimming area as indicated by arrows 46 and through return paths 26 and 30 from the water exit end of the swimming area to the water entrance end of the swimming area. The direction of flow of water throughout the apparatus is shown by arrows 46. The water circulation means may include first and second pairs of propellers comprising individual propellers 34, 36, 38 and 40 located in return paths 26 and 30. These propellers are preferably driven by hydraulic motors which will be described below in connection with FIG. 4.

A swimming apparatus, constructed in accordance with the present invention, further includes four vane sets in return paths 26 and 30. Two sets are located at each of water entrance end 14 and water exit end 16 of swimming area 12. Vane sets 42, 44, 48 and 50 occupy the left front, right front, left rear and right rear corners of tank 10 respectively. An enlarged view of vane set 42 is shown in FIG. 3.

Figure 3:
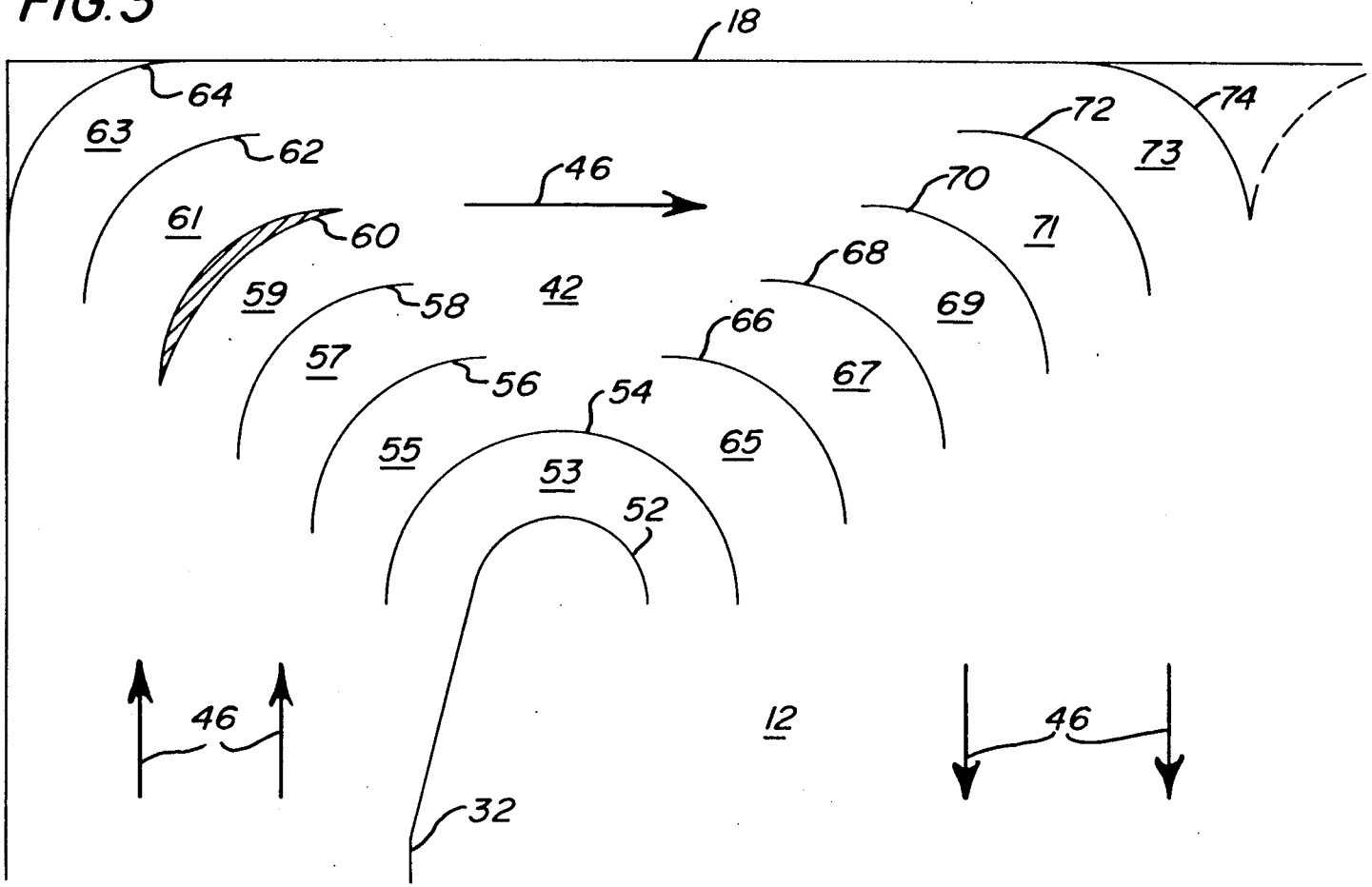
FIG. 3 is an enlarged view of the section of FIG. 1 within the dashed lines.

As may be seen from FIG. 3, vane set 42 comprises individual vanes 52, 54, 56, 58, 60, 62, 64, 66, 68, 70, 72 and 74, which define water flow paths 53, 55, 57, 59, 61, 63, 65, 67, 69, 71 and 73 therebetween. Each water flow path has a Water entrance end and a water exit end corresponding to upstream and downstream ends of the flow path. The individual vanes of vane set 42 are arranged as shown in FIG. 3 such that vane set 42 turns the flowing water 180°. The vanes are arranged from the left front corner of tank 10 to the front end of left interior wall 32, and from the end of left interior wall 32 to the midpoint of front endwall 18. Vanes 54, 56, 58, 60, 62 and 64 are equispaced and flow paths 55, 57, 59, 61 and 63 are identical.

Velocity gradient vanes 52, 54, 66, 68, 70, 72 and 74 are unevenly spaced to produce a horizontal velocity gradient in water moving through swimming area 12. For a given flow path of 53, 65, 67, 69, 71 and 73, the exit end of the flow path is generally wider than the entrance end of the flow path. The "width of a flow path is the distance between adjacent vanes defining the flow path. This is dependent upon the relative widths of first return path 26 and swimming area 12.

If swimming area 12 is more than twice the width of first return path 26, the downstream ends of the flow paths will be larger than the upstream ends, in order to properly distribute the flowing water. If swimming area 12 is less than twice the width of first return path 26, the downstream ends of the flow paths will be smaller than the upstream ends. The ratio of the width of the exit end of a flow path to the width of the entrance end of the same flow path is thus dictated by the proportions of tank 10.

However, the relationship among the ratios of the width of the entrance end to the width of the exit end of each of flow paths 53, 65, 67, 69, 71 and 73 is independent of the tank proportions. The ratio of the widths of the entrance end to exit end of flow path 65 is smaller than that ratio for flow path 67. The ratio of widths of the entrance end to exit end for flow path 67 is smaller than that for 69. The ratio of those widths for flow path 69 is smaller than that for 71 and the ratio for flow path 73 is largest. Therefore the ratio of the widths of the entrance end of a flow path to the exit end of the same flow path is greater for flow paths nearer the center line of swimming area 12. This spacing results in a horizontal velocity gradient across swimming area 12 whereby the water nearest the center of swimming area 12 is flowing faster than water near right and left interior walls 28 and 32.

The individual vanes minimize turbulence in changing water flow direction, and create this horizontal velocity gradient. All vanes (turning vanes and velocity gradient vanes) change the water flow direction, while vanes 52, 54, 66, 68, 70, 72 and 74 also act to create the horizontal water velocity gradient. By minimizing turbulence, the vanes decrease the overall energy requirements of the swimming tank. In order to minimize turbulence even further, all vanes may be shaped as shown by vane 60 in FIG. 3. In this way, flow path 59 maintains a constant width throughout the flow path. Vane 60 is shown for illustrative purposes only. In the embodiment illustrated in FIG. 1, all vanes are of the same configuration.

Vane sets 48 and 50 may be configured similarly to vane sets 42 and 44. Vane sets 48 and 50 may have both unevenly spaced velocity gradient vanes and evenly spaced turning vanes. However, this is not necessary. Although it is important to include these vane sets in the apparatus (in order to provide for efficient redirection of the flowing water into return paths 26 and 30) all vanes in vane sets 48 and 50 may be evenly spaced, without incurring increased energy consumption. Since no velocity gradient is needed in return paths 26 and 30, none of the vanes in vane sets 48 and 50 need to be velocity gradient vanes.

Water is circulated through the swimming apparatus by propellers 34, 36, 38 and 40 in return paths 26 and 30. The propellers are hydraulically driven. This may be more clearly seen from FIG. 4. A hydraulic pump 78 pumps hydraulic fluid from a reservoir 80 to propellers 34, 36, 38 and 40.

Pump 78 operates at a constant volumetric flow rate. A bypass valve 76 operates to control hydraulic fluid flow to propellers 34, 36, 38 and 40. Since pump 78 operates in this manner, hydraulic fluid is drawn off before it reaches the propellers to vary the speed of the propellers. Therefore, by opening valve 76, hydraulic fluid from pump 78 is redirected to reservoir tank 80. Less fluid reaches the propellers and, therefore, the propellers are slowed. The flow rate through swimming area 12 can thus be regulated by manipulation of valve 76.

Hydraulic pump 78 is electrically operated. Since the water flow rate is controlled by way of valve 76, this valve may be located within swimming apparatus 10. Therefore the swimmer may operate the valve without danger of electrical interaction or electrocution.

As previously explained, the turning vanes create a horizontal water velocity gradient through swimming area 12. As the swimmer swims in the middle of swimming area 12, water near the swimmer is moving more swiftly than water farther from the swimmer. This allows the swimmer to remain in a region of higher water velocity, but in a larger pool and with less electrical energy consumption than would otherwise be required.

The swimmer may feel the additional water to the left and right, or accidentally reach out into it, yet this water need not be circulated swiftly. Therefore, energy consumption is reduced.

This results in a very low velocity or stagnant water area adjacent interior walls 28 and 32. This stagnant water area increases the feeling of space to the swimmer, without increasing the amount of water needed to be circulated through the swimming area. The swimming area may be made large enough to avoid a restricted feeling to the swimmer, while still maintaining a high water velocity where needed with minimum energy requirements.

To further increase water velocity in that portion of swimming area 12 where the swimmer is to be located, block 82 is added as may be seen in FIG. 2. Block 82 is a board or similar flat object, which is placed against individual turning vanes 52 and 54 and which extends across the full width of swimming area 12 and approximately half the height of swimming area 12. This causes the entire flow from return paths 26 and 30 to be directed into the upper half of swimming area 12 and creates a vertical velocity gradient where the velocity of the water is greatest at or just below the surface of swimming area 12 and decreases with depth of water.

The magnitude of this vertical velocity gradient is smaller for cross sections of swimming area 12, nearer rear endwall 20. That is, the difference in velocity from the surface of swimming area 12 to the floor of swimming area 12, decreases from the front of swimming area 12 to the rear of swimming area 12, as swiftly flowing water near the surface mixes with more slowly moving water near the floor of swimming area 12.

Thus, as the swimmer moves toward the rear of the tank, the velocity of the water flowing past the swimmer decreases. This enables the swimmer to maintain his or her position in the tank with less effort near the rear of swimming area 12 than required toward the front of swimming area 12. Further, this increases the velocity of the water in the vicinity of the swimmer without increasing the water circulation rate or power requirements.

The invention has been described as a continuous swimming tank in the best mode known to the applicant. However it will be apparent that the invention may be varied in many ways. Such variations are not to be regarded as a departure from the spirit and scope of the appended claims.

I claim:

1. A swimming apparatus comprising: a tank adapted to contain water and having:

(a) a swimming area through which water flows from a water entrance end to a water exit end; and (b) return means for directing water from said water exit end of said swimming area to said water entrance end of said swimming area; water circulation means in said return means for circulating water through said swimming area from said water entrance end of said swimming area and through said return means from said water exit end of said swimming area to said water entrance end of said swimming area; and a plurality of velocity gradient vanes in said return means at said water entrance end of said swimming area spaced in such a manner as to create a horizontal water velocity gradient across said swimming area in which water close to the center line of said swimming area has a higher velocity than water nearest the sides of said swimming area.

2. The apparatus of claim 1, wherein said vanes define water flow paths therebetween, each said water flow path having an entrance end and an exit end, the width of said flow path entrance end being smaller than the width of said flow path exit end, and the ratio of the width of said flow path at said entrance end to the width of said flow path at said exit end being greater for flow paths nearer the center line of said swimming area.

3. The apparatus of claim 1, wherein said water circulation means comprises hydraulically driven propellers in said return means, means for supplying hydraulic driving fluid to said water circulation means at a constant flow rate, and means to vary the volumetric flow rate of hydraulic fluid to said propellers, whereby the speed of rotation of said propellers is controlled.

4. The apparatus of claim 2, further including means for developing a vertical water velocity gradient at said water entrance end of said swimming area, in which the water velocity decreases from the water surface to the floor of said tank.

5. The apparatus of claim 4, wherein said means for developing a vertical water velocity gradient at said water entrance end of said swimming area comprises a vertical barrier extending horizontally across said entrance end of said swimming area, and extending vertically across the lower half of said swimming area.

6. The apparatus of claim 2 further including turning vanes adjacent said water entrance and said water exit ends for altering the direction of flow of said water.

7. The apparatus of claim 6 wherein said turning vanes define water flow paths therebetween, each said water flow path defined by said turning vanes having a constant width through said path.

8. The apparatus of claim 1, wherein said water circulation means comprises;

hydraulically driven propellers;

a constant volumetric flow rate electrically driven hydraulic fluid pump; and means for varying the rate of circulation of said water by controlling said hydraulic fluid flow rate to said propellers.

9. A swimming apparatus comprising;

a four-sided tank adapted to contain water and having:

(a) four corners;

(b) a swimming area through which water flows from a water entrance end to a water exit end;

(c) return means for directing water from said water exit end of said swimming area to said water entrance end of said swimming area;

(d) four sets of vanes, one in each of said four corners, said vanes redirecting flowing water from said swimming area to said return means and from said return means to said swimming area, said sets of vanes including velocity gradient vanes spaced in such a manner as to create across said swimming area a horizontal water velocity gradient, the velocity gradient being such that water close to the center line of said swimming area has a higher velocity than water nearer the sides of said swimming area; and water circulation means comprising hydraulically driven propellers in said return means for circulating water through said swimming area from said water entrance end of said swimming area to said water exit end of said swimming area and through said return means from said water exit end of said swimming area to said water entrance end of said swimming area;

a constant volumetric flow rate electrically driven hydraulic fluid pump; and means for varying the rate of circulation of said water by controlling said hydraulic fluid flow rate to said propellers.

10. A swimming apparatus comprising:

a rectangular tank adapted to contain water and having right and left sidewalls and front and rear endwalls, said sidewalls being longer than said endwalls;

right and left interior walls extending parallel to said sidewalls within said tank with the ends of said interior walls spaced from said front and rear endwalls to define:

(a) a swimming area between said interior walls;

(b) a first return path extending between said right interior wall and said right sidewall from a water entrance end of said swimming area to a water exit end of said swimming area; and (c) a second return path extending between said left interior wall and said left sidewall from said water entrance end of said swimming area to said water exit end of said swimming area;

first water circulation means in said first return path for circulating water through said swimming area from said water entrance end of said swimming area to said water exit end of said swimming area and through said first return path from said water exit end of said swimming area to said water entrance end of said swimming area;

second water circulation means in said second return path for circulating water through said swimming area from said water entrance end of said swimming area to said water exit end of said swimming area and through said second return path from said water exit end of said swimming area to said water entrance end of said swimming area;

a first set of velocity gradient vanes in said first return path at said water entrance end of said swimming area spaced in such a manner as to create a horizontal water velocity gradient across said swimming area in which water close to the center line of said swimming area has a higher velocity than water nearer said right interior wall; and a second set of velocity gradient vanes in said second return path at said water entrance end of said swimming area spaced in such a manner as to create a horizontal water velocity gradient across said swimming area in which water close to the center line of said swimming area has a higher velocity than water nearer said left interior wall.

11. The apparatus of claim 10, wherein said velocity gradient varies define water flow paths therebetween, each said water flow path having an entrance end and an exit end, the width of said flow path entrance end being smaller than the width of said flow path exit end, and the ratio of the width of said flow path at said entrance end to the width of said flow path at said exit end being greater for flow paths nearer the center line of said swimming area.

12. The apparatus of claim 11, further including means for developing a vertical water velocity gradient at said water entrance end of said swimming area, in which the water velocity decreases from the water surface to the floor of said tank.

13. The apparatus of claim 12, wherein said means for developing a vertical water velocity gradient at said water entrance end of said swimming area comprises a vertical barrier extending horizontally across said entrance end of said swimming area, and extending vertically across the lower half of said swimming area.

14. The apparatus of claim 10, wherein said water circulation means comprises hydraulically driven propellers in said return means, means for supplying hydraulic driving fluid to said water circulating means at a constant flow rate, and means to vary the volumetric flow rate of hydraulic fluid to said propellers to control the speed of rotation of said propellers.

15. The apparatus of claim 10 further including:

a third set of vanes in said first return path at said water exit end of said swimming area for redirecting flowing water from said swimming area to said first return path; and a fourth set of vanes in said second return path at said water exit end of said swimming area for redirecting flowing water from said swimming area to said second return path.

* * * * *